United States Patent [19]

Yaghmaie et al.

[11] Patent Number: 4,502,868

[45] Date of Patent: Mar. 5, 1985

[54] COAL-WATER SLURRIES OF LOW VISCOSITY AND METHOD FOR THEIR PREPARATION

[75] Inventors: Farrokh Yaghmaie, Wappinger Falls; Ronald J. Mc Keon, Beacon, both of N.Y.

[73] Assignee: Texaco Inc., White Plains, N.Y.

[21] Appl. No.: 423,939

[22] Filed: Sep. 27, 1982

[51] Int. Cl.[3] ..... C10L 1/32

[52] U.S. Cl. ..... 44/51; 252/312; 252/353; 406/47; 406/197; 260/505 C

[58] Field of Search ..... 44/51; 252/312, 353; 406/47, 49, 197; 260/505 C

[56] References Cited

U.S. PATENT DOCUMENTS

| | | | |
|---|---|---|---|
| 3,019,059 | 1/1962 | McMurtie | 406/49 |
| 3,835,183 | 9/1974 | Carpenter et al. | 423/460 |
| 4,104,035 | 8/1978 | Cole et al. | 44/51 |
| 4,177,039 | 12/1979 | Sakuma et al. | 44/51 |

FOREIGN PATENT DOCUMENTS

| | | | |
|---|---|---|---|
| 54-73805 | 6/1979 | Japan | 44/51 |

*Primary Examiner*—William R. Dixon, Jr.
*Assistant Examiner*—Margaret B. Medley
*Attorney, Agent, or Firm*—Robert A. Kulason; Carl G. Seutter

[57] ABSTRACT

Coal-water slurries having high solids contents and improved pumpability containing a viscosity improving additive comprising a sulfonated product of humic acids.

13 Claims, No Drawings

COAL-WATER SLURRIES OF LOW VISCOSITY AND METHOD FOR THEIR PREPARATION

BACKGROUND OF THE INVENTION

1. Field of the Invention

This invention relates to a process for the improvement of the flow characteristics of slurries of solid fuels and mineral matter in water. More particularly it is concerned with a process for the production of coal-water slurries which are made better Bingham plastics by the incorporation therein of a prescribed group of additives as hereinafter more fully described. Thereby reduced viscosities are obtained at high rates of applied shear. This fact in turn is advantageous both by virtue of the savings in pumping energy which are effected as well as by virtue of the longevity which is imparted to the pumping equipment involved.

Most solid carbonaceous fuels, as mined, generally contain varying amounts of water, which in some instances may be as high as 40 wt. % or even higher in the case of low grade solid fuels. This water is an undesirable constituent of the fuel, particularly in the case of fuels of high water content. Thus a slurry containing 50 wt. % water and 50 wt. % solid fuel would contain considerably less than that amount of fuel when the fuel is measured on a dry basis.

Furthermore, when coal is transported in slurried form any excess amount of water merely reduces the transportation efficiency.

The amount of water necessary to form a pumpable slurry depends on the surface characteristics of the solid fuel. For example, soot formed during the partial oxidation of a carbonaceous material has such a high surface area that a concentration of such soot in water in excess of a few wt. % renders the resulting slurry unpumpable. In the case of a slurry which is to be fed to a gas generator, it is necessary that the solid fuel be ground to such an extent that a major portion thereof will pass through a 200 mesh sieve so that the particles are substantially completely converted to oxides of carbon during their short residence time within the gasification zone. However, ordinarily before reaching the gasification zone the slurry must pass through various pieces of equipment such as heat exchangers and compressors on its way from the slurry zone to the gas generation zone. Accordingly the slurry must be pumpable but in the case of a slurry made up of solid fuel particles most of which will pass through a 60 mesh sieve it has been found that ordinarily a pumpable slurry must contain from about 55 to 60 wt. % water. Unfortunately a slurry containing this amount of water renders the operation of the gasifier unsatisfactory as this excessive amount of water moderates the temperature of the reaction zone to such an extent that it seriously affects its thermal efficiency. It has been found that the optimum amount of water in a solid fuel-water slurry which may be used as feed to a gas generation zone will lie from between 40 and 50 wt. %. A water content of 30 wt. % would be even more preferable, if it could be achieved. However, in the case of such aqueous slurries, the viscosity is remarkably increased with a loss in flowability if the coal concentration is increased beyond a certain point. On the other hand, if the concentration of the coal therein is reduced, both the transportation and the gasification efficiencies are lowered as already noted and an expensive dehydration step is required to recover dry coal.

Increase of coal content and reduction of the viscosity of a coal-water slurry are therefore mutually exclusive processes in ordinary circumstances although it would be desirable to achieve both.

Increase of the viscosity and reduction of the flowability in an aqueous slurry of coal are due to agglomeration of the coal particles in an aqueous slurry. Agglomeration is further aided by increased coal concentrations. The finer the particle size of dispersed coal powder, the better is the dispersion stability thereof. However, the cost of pulverization is increased if the degree of pulverization is enhanced. Finely divided coal now used in thermoelectric power plants has such a size that 80% of the particles will pass through a 200-mesh sieve.

It may be considered that if a surface active agent acting as a dispersant is added to an aqueous slurry of coal powder, the surface active agent will adsorb onto the coal particles and will exert the desirable functions of crumbling agglomerated particles and also preventing agglomeration of coal particles with the result that a good dispersion state will be attained.

It is therefore an object of this invention to produce solid fuel- water slurries having a relatively high solids content. Still another object of the invention is to produce pumpable slurries of solid fuel in water wherein the bulk of the solid fuel will pass through a sieve as fine as 60 mesh and in which the water content of the slurry will range between about 40 and 50 wt. %. Yet another object of the invention is to produce an improved Bingham plastic slurry, which by definition is handled with lower expenditure of energy as a result of lowered viscosity at high shear rates which may be expected at high rates of flow. Yet another object of the invention is to extend the useful life of pumping equipment by lowering the viscosity of the slurries pumped when operating at customary shear rates. Yet another object of the invention is to provide a cheap and uncomplicated method of coal-water slurry rheology control from readily available materials, which would be especially beneficial in areas where prior art viscosity controlling agents such as wood derived lignosulfonates are in short supply or not available. These and other objects will become apparent on further reading of this specification.

DESCRIPTION OF THE PRIOR ART

U.S. Pat. No. 3,835,183 discloses a method for making and a sulfonated aromatic product for use in the production of activated carbon and as a binder for the production of activated carbon pellets or briquettes.

U.S. Pat. No. 4,282,006 discloses a formula covering particle size distribution of coal particles in an aqueous medium to minimize the volume of the required water carrier medium with an advantageous amount of colloidal sized particles. Said reference also discloses the use of alkyl mononaphthalene sulfonic acid and its ammonium and sodium salts as dispersing agents for the resulting coal-water slurries.

U.S. Pat. No. 4,104,035 discloses a method for decreasing water requirements in the preparation of a coal-water slurry which involves the high pressure heating to 300° F. without boiling of a coal-water slurry followed by addition of a surface active agent specifying salts of organic sulfonic acids in general and ammonium, calcium and sodium lignin sulfonates in particular.

U.S. Pat. No. 4,302,212 discloses coal-water slurries employing as a dispersing agent, an anionic surface active agent having the formula:

$$[R—O—(—CH_2CH_2O—)—_mSO_3]_nM$$

wherein R is an alkyl or alkenyl group having 6 to carbon atoms or an alkyl- or alkenyl-substituted aryl group having 4 to 22 carbon atoms in the substituent thereof, m is an integer of from 2 to 50, n is a number of from 1 to 3 and is the same as the valence of the counter ion M, and M is a cation having a valence of from 1 to 3.

U.S. Pat. No. 4,330,301 discloses dispersants for forming coal-water slurries which include sulfonation products of polycyclic aromatic compounds which may have a hydrocarbon group as a substituent, salts thereof and formaldehyde condensates thereof.

U.S. Pat. No. 3,034,982 and U.S. Pat. No. 3,135,727 (covering a similar disclosure, but with differing claims) disclose a method for making sulfo-alkylated lignites and related compounds and their use in controlling the yield point of drilling fluids.

U.S. Pat. No. 3,035,867 discloses a method for making coal derived acids and the use thereof and of their alkaline metal salts in lowering the viscosity of phosphate rock slurries.

SUMMARY OF THE INVENTION

According to this invention there is provided a process for improving the pumpability of a solid fuel-water slurry which comprises adding to said slurry the reaction product of the sulfonation of the humic acid content of low rank coal as hereinafter more fully described in amounts ranging up to about 5 wt. % preferably from about 1.5 to about 2.0 wt. % based on the total weight of the slurry. In a preferred embodiment of our invention the water soluble sulfonation reaction product is added, to the solid fuel prior to or during its wet grinding and the subsequent addition of sufficient water to form a pumpable slurry. Such slurry ordinarily contains from about 40 wt. % to about 70 wt. % of solid fuel.

In some applications involving partial oxidation of solid fuels, corrosion of the refractory lining of the gasifier as a result of attack by alkaline metals may be a problem. Such alkaline metals are generally present as the residual ash or slag component of the solid fuel being partially oxidized. Therefore, alkali metals present in a viscosity improving additive may add to the ash content of the solid fuel being gasified and increase ash handling difficulties. In such cases, the ammonium, rather than alkaline metal salts of the sulfonated humic acid additives of our invention may be advantageously employed.

Any solid fuel such as anthracite, bituminous coal, sub-bituminous coal, coke and lignite may be used in the process of this invention for the making of aqueous slurries. In the preparation of the viscosity reducing additives of our invention, low rank coals may be advantageously used. The solid fuel to be slurried should be in finely-divided form so that all of the pulverized solid fuel passes through at least a 60 mesh sieve (U.S. standard).

DETAILED DESCRIPTION OF THE INVENTION

The sulfonation product of humic acid, e.g., as derived from low rank coal as used as an additive in the making of the coal-water slurries of our invention may be characterized as a surfactant. The term "surfactant" indicates any substance that alters energy relationships at interfaces, and, in particular, a synthetic organic compound displaying surface activity including wetting agents, detergents, penetrants, spreaders, dispersing agents and foaming agents.

The active ingredient of the additive of our invention comprises the sulfonation product of humic acids and their salts, which may be described as humosulfonates.

Humic acids have been defined as allomelanins found in soils, coals and peat, resulting from the decomposition of organic matter, particularly dead plants. Said acids comprise a mixture of complex macromolecules having polymeric phenolic structures with the ability to chelate with metals, especially iron. It is a chocolate-brown, dust-like powder which is slightly soluble in water, usually with much swelling and soluble in alkaline hydroxides and carbonates. It is also soluble in hot, concentrated nitric acid with the assumption of dark red coloration. Humic acids have been found useful in mud baths, drilling muds, pigments for printing inks, fertilizers, growth hormones for plants and the transport of trace minerals in soil, see The Merck Index, 9$^{th}$ Ed., 1976 citing "Melanins" (Hermann, Paris, 1968) pp. 147–153 and Steelnick, J. Chem. Ed. 40, 379 (1963).

It should be noted that humic acids are particularly abundant in low grade solid fuels including peat and peat moss. Chemically, peat moss consists of about 50%, by weight, lignin and humic acids with the remainder consisting of hemicellulose, cellulose, waxes and nitrogen compounds.

Accordingly, the use of the humic acid derivatives of our invention may be especially advantageous in areas where wood derived lignosulfonate viscosity reducing prior art additives are expensive or unavailable or in short supply.

The coal-water slurry additive of our invention may also be characterized as a dispersing agent. A dispersing agent is a form of surface-active agent which may be organic or inorganic and which is present on or in or is added to the coal or water or to the coal-water slurry and acts to create or to promote formation of a repulsive electrostatic charge on a coal particle in an aqueous medium at the interface of the bound water layer on a particle and of the diffuse layer of the bulk or "carrier water" surrounding the particle.

When water is added to a powder comprising finely divided particles, and providing that the water "wets" the powder, a surface water film is adsorbed on each particle which is known to be structurally different from the surrounding "free" or bulk water, in that the film may be described as "semi-rigid", or bound water film. Depending on the fundamental electrical potential of the surface, this "semi-rigid" or bound water film may be of several molecules thickness. For example, on clays, the film has been estimated to be about 80 A°. thick.

However, by the use of the additives of our invention in combination with the carrier water of the coal-water slurries of our invention dispersion of the coal particles is achieved to separate the particles by repulsive charges in a known way in accordance with electrochemical principles. This step provides counterions which are believed to minimize the thickness of the bound water layer on a particle, and in effect affects its structure.

Insofar as viscosity reduction is concerned, it should be noted that a Bingham plastic fluid is ordinarily not a liquid but a suspension, as is a coal-water slurry. Thus with a loose agglomeration of suspended particles at low shear rates there is considerable inter particle friction leading to a high viscosity. With increasing applied shear rates there is a break down of such particle agglomeration with consequent decreased internal friction and reduced viscosity. Naturally, at certain high shear rates, the particle separation reaches its practical maximum with the corresponding minimal, asymptotic viscosity. Moreover, at extraordinarily high shear rates, some separation of the particles from the medium due to centrifugal action may occur, thereby adversely affecting the homogeneity of the slurry. Carbon particle separation is therefore achieved ordinarily with mechanical agitation alone as a result of an externally applied shear stress. However, said separation is further assisted by the additives of our invention causing electrostatic repulsion between carbon particles following the adsorption of such additives on such carbon particles. A minimal or asymptotic viscosity is reached quicker with the assistance of said additives.

In any given situation the preferred embodiment of our invention, as contemplated by us will depend on the available adsorption surface area of the pulverized coal which is to be slurried as has already been noted above.

The available adsorption surface area depends upon numerous factors such as the maximum and minimum particle sizes and size distribution in any given sample of pulverized coal, the rank of the coal, unavailability of portions of the free surface area as a result of oxidation, slag particles and the like.

In general, an excess of the additives of our invention must be avoided. Such excess additive molecules which are not adsorbed may reduce the specific gravity of the aqueous medium and the resulting increased differential in specific gravities between the aqueous and solid media will in turn lead to increased difficulties in maintaining the coal-water slurry as a stable suspension. Also, at higher concentrations other competing processes such as micelle formation of our additive molecules can occur, which could reduce the number of additive molecules available to be adsorbed upon the coal surfaces. The optimal amount of our additives needed will be determined by such factors as coal particle size and available surface area and the other factors discussed above.

Being mindful of the uncertainties caused by the nature of the coal utilized and the degree of its comminution (and particle size distribution), we contemplate in the preferred embodiment of our invention, the use of no more than about 5 wt. % (based on the total weight of the slurry) of our surfactant additive in an aqueous slurry containing more than about 50 wt. % slurried coal particles.

In the practice of our invention it is preferred also that our additives be employed at the grinding mill stage while effecting wet grinding and before the addition of a major portion of the water required to make a pumpable slurry. This method is beneficial for the following two reasons.

First, the additives serve as grinding aids by maintaining a low coal-water paste viscosity during grinding.

Second, the additives are immediately available for adsorption on the new surfaces generated during comminution of the coal. Accordingly, need for later treatment is minimized or eliminated, thus saving time, energy, and materials costs.

In order to make a pumpable comminuted solid fuel-water slurry comprising from about 50 to about 70 weight percent of solid fuel comminuted to at least 60 mesh size and containing up to about 5.0 weight percent of our surfactant additive in an aqueous medium following the above procedure, the following steps are taken. From about 50 to about 70 parts by weight of a solid fuel selected from the group consisting of lignite, subbituminous, bituminous and anthracite coals is mixed with a minor portion, e.g., from about 1 to about 24 parts by weight of water; the resulting solid fuel-water mixture is comminuted to form a solid fuel-water paste comprising solid fuel particles not exceeding 60 mesh size; from about 0.01 to about 5.0 parts by weight of our surfactant additive is added to said solid fuel-water mixture prior to commencement of comminution or during comminution or in part prior to commencement of comminution and in part during the process of comminution but in any event prior to completion of comminution and finally a major portion, e.g., from about 13 to about 49 parts by weight of water is added to said solid fuel-water paste to form said pumpable solid fuel-water slurry. Alternatively, said surfactant may be dissolved in said minor portion of water beforehand and the water containing such dissolved surfactant mixed with said solid fuel prior to commencement of comminution.

The following is a description of a method of carrying out the present invention.

A sample of any material containing humic acids, such as coal, preferably a low rank coal, e.g. lignite, is ground finely enough so that all of it passes through a 60 mesh sieve. A base is added to said coal prior to, simultaneously with or subsequent to said grinding stage. The amount of the base added should be stoichiometrically sufficient to neutralize the acidity content of the ground coal as determined by the prior analysis of a representative sample of said coal. Any base may be utilized for the foregoing purpose although in practice, resort may be had to the more readily and cheaply available bases such as $NH_4OH$, $NaHCO_3$, $Ca(OH)_2$, $NaHSO_3$ and the like. The use of $NH_4OH$ may be especially advantageous as already noted above in situations where the corrosive effects of alkali metals are to be minimized.

The resulting mixture is generally heated to about 50° C. and held at said temperature for about an hour to speed the neutralization reaction. Thereafter, gaseous sulfur dioxide is contacted with said reaction mixture under sulfonation reaction conditions, preferably at ambient temperature and above about 25 p.s.i.g. pressure. In practice a pressure range of from about 25 p.s.i.g. to about 35 p.s.i.g. will be found to be satisfactory although higher operating pressures may also be gainfully utilized. The sulfonation is completed to the desired degree when no more sulfur dioxide is absorbed by said reaction mixture as evidenced, e.g., in a laboratory scale synthesis by the failure of the sulfur dioxide total or partial pressure (as applicable) to continue to drop, with the passage of time.

The humosulfonates thus synthesized are extracted by washing the reaction mixture with water, removing unreacted solid particulate matter, preferably by filtration and evaporating the filtrate to dryness with gentle heating, e.g., on a steam bath.

In practice, when said humosulfonates are used as viscosity reducing additives to coal-water slurries, it is not necessary to remove unreacted coal particles by filtration or otherwise as the entire reaction product can be advantageously incorporated into a coal-water slurry.

Following the above general procedure, ammonium and sodium humosulfonates were prepared and their viscosity reducing effects compared with those of two different grades of a commercially available lignosulfonate when incorporated into coal-water slurries as more fully described in the following examples. Said slurries were also compared with additive free control coal-water slurries. All such slurries were subjected to two different shear rates and their corresponding viscosities, as determined by a drag viscometer are shown in the Table below.

CONTROL EXAMPLES A, B AND C

A bituminous coal (Illinois No. 6) ground so that it had a particle size distribution ranging from 60 mesh and up to and including 325 mesh was slurried in distilled water and no additive was incorporated therein. Said slurry (Control Example A) had a coal concentration of 61.0 wt. %. Such additive free slurry was subjected to varying shear rates and the corresponding viscosities are noted in the Table below.

In an identical manner a bituminous coal-water additive free slurry (Control Example B) of 61.85 wt. % coal concentration was prepared and subjected to the same treatment. The viscosity readings obtained are shown in the Table below.

Likewise, a third bituminous coal-water additive free slurry (Control Example C) of 50.25 wt. % coal concentration was prepared and subjected to the same treatment. The viscosity readings obtained are likewise shown in the Table below.

CONTROL EXAMPLES W,X,Y AND Z

A sample of bituminous coal (Illinois No. 6) ground so that it had a particle size distribution of from 60 mesh up to and including 325 mesh was slurried in distilled water containing known amounts of two different grades of a commercially available lignosulfonate, namely, Orzan and Orzan A, which are available from Crown Zellerbach Corporation, Chemical Products Division, Vancouver, State of Washington, United States of America.

The resulting slurry of Control Example W contained 61.8 wt. % coal and 1 wt. % of the Orzan A lignosulfonate, the rest comprising water.

The resulting slurry of Control Example X contained 61.47 wt. % coal and 1 wt. % of the Orzan lignosulfonate, the rest comprising water.

The resulting slurry of Control Example Y contained 61.47 wt. % coal and 1 wt. % of the Orzan A lignosulfonate, the rest comprising water.

The resulting slurry of Control Example Z contained 61.82 wt. % coal and 1 wt. % of the Orzan lignosulfonate, the rest comprising water.

All of the above four control slurries incorporating the aforesaid prior art commercially available viscosity reducing additives were subjected to varying rates of shear and the corresponding viscosity readings thus obtained are set forth in the Table below.

EXAMPLE I

A sample of bituminous coal (Illinois No. 6) ground so that it had a particle size distribution of from 60 mesh up to and including 325 mesh was slurried in distilled water containing a known amount of one of the additives of our invention comprising ammonium humosulfonates.

The resulting slurry contained 61.53 wt. % of coal and 1.5 wt. % of the aforementioned additive of our invention, the rest comprising water.

Such slurry was subjected to varying rates of shear and the corresponding viscosity measurements which were obtained are set forth in the Table below.

EXAMPLE II

Following the exact procedure of Example I, another slurry was prepared which contained 61.43 wt. % coal and 1.5 wt. % of the ammonium humosulfonates additive of our invention, the rest comprising water.

Such slurry was subjected to identical treatment and the viscosity readings obtained are set forth in the Table below.

EXAMPLE III

Following the exact procedure of Example I, another slurry was prepared which contained 50.0 wt. % coal and 2.0 wt. % of the ammonium humosulfonates additive of our invention, the rest comprising water.

Such slurry was subjected to identical treatment and the viscosity readings obtained are set forth in the Table below.

EXAMPLE IV

Following the exact procedure of Example I, another slurry was prepared which contained 52.0 wt. % coal and 2.0 wt. % of the sodium humosulfonates additive of our invention, the rest comprising water.

Such slurry was subjected to identical treatment and the viscosity readings obtained are set forth in the Table below.

TABLE

| Example | Coal wt. % | Additive Incorporated | Applied Shear Rates (Sec.$^{-1}$) 5.1 Viscosity (Poises) | 10.2 |
|---|---|---|---|---|
| A | 61.0 | None | 34 | 20 |
| B | 61.85 | " | 28 | 20 |
| C | 50.25 | " | 32 | 18 |
| W | 61.8 | 1 wt. % Orzan A | 5 | 4.50 |
| X | 60.43 | 1 wt. % Orzan | 4 | 3 |
| Y | 61.47 | 1 wt. % Orzan A | 6 | 4.5 |
| Z | 61.82 | 1 wt. % Orzan | 8 | 5 |
| I | 61.53 | 1.5 wt. % ammonium humosulfonates | 5 | 4.25 |
| II | 61.43 | 1.5 wt. % ammonium humosulfonates | 5 | 4.75 |
| III | 50.0 | 2.0 wt. % ammonium humosulfonates | 20 | 11.0 |
| IV | 52.0 | 2.0 wt. % sodium humosulfonates | 16 | 9 |

Inspection of the data in the above Table shows that the slurries containing the additives of our invention (Examples I to IV) were particularly affected by said additives in having their respective viscosities reduced, at the low shear rates to which they were subjected, namely, 5.10 and 10.20 Sec.$^{-1}$ when viscosity reduction due solely to mechanical agitation causing breakdown of agglomerated coal particles is minimal.

In contrast, the control Examples A, B and C containing no additive, had considerably higher viscosities at these same shear rates.

In particular it will be seen that in Control Examples A and B, and in Examples I and II all involving bituminous coal-water slurries, even though all the coal concentrations are roughly equal, the slurries containing the additives of our invention show markedly lower viscosities. In fact the slurries containing the additives of our invention (as compared to the additive free slurries) showed viscosity reduction ranging from about 76% to about 85%. Again, as noted above, this fact is remarkable as at low rates of applied shear viscosity reduction due solely to mechanical agitation (causing the breakdown of agglomerates) is at a minimum. Comparing likewise the slurries of Control Example C having a coal concentration of 50.25 wt. % with the additive containing slurries of Examples III and IV which are closest in coal concentration thereto (containing 50.0 and 52.0 wt. of coal respectively) it will be seen that under both of the shear rates applied to all three slurries, a viscosity reduction by a factor of at least one third and up to one half was achieved.

Comparing likewise the slurries of Control Examples W,X,Y and Z with those of Examples I and II involving roughly comparable coal concentrations it is readily apparent that the viscosity reduction caused by the additives of our invention was in most cases, at least equal to that caused by the commercially available additive studied. The only case where a slurry containing said commercially available additive showed lower viscosities over the entire range studied was in Control Example X. However, this result may be explained by the fact that the slurry of Control Example X was at least 1 wt. % lower in coal concentration than the slurries of Examples I and II containing the additives of our invention. In particular it will also be seen in the case of Control Example W and Examples I and II (all involving very nearly equal coal concentrations) that the viscosity values at the lower shear rate of 5.1 Sec.$^{-1}$ were identical (5 Poises) in all cases and the viscosity of Control Slurry W at the higher applied shear rate of 10.2 Sec.$^{-1}$, namely 4.50 Poises was an exact arithmetical average of the viscosities of the slurries of Examples I and II at the same rate of applied shear, namely 4.25 and 4.75 Poises respectively.

The only difference between the coal-water slurries of Control Examples W,X,Y and Z and those of Examples I and II is that the former slurries contain 1 wt. % of the commercially available prior art lignosulfonate additive while the latter slurries contain 1.5 wt. % of the additives of our invention. This difference is not only de minimis but becomes meaningless when it is remembered that the additives of our invention may be cheaply and readily made from a wide variety of organic starting materials including different kinds of coal itself whose ready availability may be presumed in any application involving the making of coal-water slurries. Moreover, as noted above, when carbonaceous fuels are used as a source of humic acids for the preparation of the additives of our invention the entire reaction mixture may advantageously be incorporated into the carbonaceous fuel-water slurry which is ultimately prepared without having to resort to any step for the separation of the prepared humosulfonates from the unreacted carbonaceous fuel particles thereby adding to the simplicity of the use of the additives of our invention as viscosity reducing agents for such carbonaceous fuel-water slurries.

From the above data it is now apparent that the use of the prescribed group of sulfonated products of humic acids, and their salts as viscosity reducing agents in carbonaceous solid fuel-water slurries have the added advantage of rendering such slurries Bingham plastic fluids whereas in the absence of such an additive the coal-water slurry is a Bingham plastic only up to a certain rate of shear and then becomes dilatant.

Moreover, as described, one can increase the coal content of the slurry and achieve the processing of greater quantities of slurried fuel by using the additives of our invention.

Various modifications of the invention as hereinbefore set forth may be made without departing from the spirit and scope thereof, and therefore, only such limitations should be made as are indicated in the appended claims.

We claim:

1. A comminuted solid fuel-water slurry having improved pumpability properties which comprises from about 50 to about 70 weight percent of a smaller than 60 mesh comminuted fuel, from about 50 to 30 weight percent water and from about 0.01 to about 5.0 weight percent of a surfactant comprising a sulfonation product of humic acids in which said surfactant is prepared by grinding organic material bearing humic acids to at least 60 mesh size; neutralizing said humic acids with a base to form a reaction mixture and contacting said reaction mixture with sulfur dioxide under sulfonation conditions until a substantial part of the humic acids contents of said reaction mixture is sulfonated to form said surfactant.

2. The solid fuel-water slurry of claim 1 in which said surfactant is prepared from a carbonaceous fuel selected from the group consisting of peat, lignite, sub-bituminous, bituminous and anthracite coals.

3. The solid fuel-water slurry of claim 2 in which the surfactant is incorporated without separation from precurser unreacted carbonaceous particles into a solid fuel-water slurry.

4. The solid fuel-water slurry of claim 1 in which the comminuted solid fuel is a coal selected from the group consisting of lignite, sub-bituminous, bituminous and anthracite coals.

5. The solid fuel-water slurry of claim 1 in which the surfactant is added in the amount of from about 1.0 to about 2.5 weight percent of the solid fuel-water slurry as a whole.

6. The solid fuel-water slurry of claim 1 in which at least 50 percent of the comminuted solid fuel passes through a 200 mesh sieve.

7. The solid fuel-water slurry of claim 1 in which at least 80 percent comminuted solid fuel passes through a 200 mesh sieve.

8. A process for preparing the pumpable comminuted solid fuel-water slurry of claim 1 which comprises mixing about 50 to 70 parts by weight of a carbonaceous solid fuel selected from the group consisting of lignite, sub-bituminous, bituminous and anthracite coals with about 1.0 to about 24.0 parts by weight of water to form a solid fuel-water mixture; adding to said solid fuel-water mixture from about 0.01 to about 5.0 parts by weight of said surfactant to form a surfactant containing solid fuel-water mixture; comminuting said surfactant containing solid fuel-water mixture to form a solid fuel-water paste comprising solid fuel particles of up to 60 mesh size and adding from about 13 to about 49 parts by weight of water to said solid fuel-water paste to form said pumpable comminuted solid fuel-water slurry.

9. The process of claim 8 in which said surfactant is added to said solid fuel-water mixture after commencement of comminution but prior to completion of comminution.

10. The process of claim 8 in which part of said surfactant is added to said solid fuel-water mixture prior to commencement of comminution and part of said surfactant is added to said solid fuel-water mixture after the commencement of comminution but prior to completion of comminution.

11. The process of claim 8 in which said surfactant is dissolved in water which is thereafter mixed with said solid fuel to form said surfactant containing solid fuel-water mixture prior to commencement of comminution.

12. The solid fuel-water slurry of claim 1 in which said surfactant is prepared from peat.

13. The solid fuel-water slurry of claim 1 in which said surfactant is prepared from lignite.

* * * * *